US005174457A

United States Patent [19]

Carroll et al.

[11] Patent Number: 5,174,457

[45] Date of Patent: Dec. 29, 1992

[54] COUPLER UNIT WEAR PAD ASSEMBLY FOR RAILROAD EQUIPMENT

[76] Inventors: Ralph Carroll, 49 Holly Dr., Olathe, Kans. 66062; Horace Smith, 4610 W. 82nd Ter., Prairie Village, Kans. 66208

[21] Appl. No.: 546,576

[22] Filed: Jun. 29, 1990

Related U.S. Application Data

[63] Continuation of Ser. No. 368,202, Jun. 19, 1989.

[51] Int. Cl.[5] ..... B61G 9/20

[52] U.S. Cl. ..... 213/61

[58] Field of Search ..... 213/50, 61, 65, 62 R

[56] References Cited

U.S. PATENT DOCUMENTS 2,271,907 2/1942 Wilson ..... 213/61

4,032,017 6/1977 Larsen ..... 213/61

*Primary Examiner*—Robert J. Oberleitner

*Assistant Examiner*—Kevin D. Rutherford

*Attorney, Agent, or Firm*—Kokjer, Kircher, Bowman & Johnson

[57] ABSTRACT

A novel wear pad assembly (22) allows worn coupler carrier wear pads of locomotives and train cars to be easily removed, replaced or reversed. A holder-tray (30) attached to the coupler housing (14) of a train car or locomotive receives a removable wear pad (32). A holder plate (34) holds removable wear pad (32) in place within holder-tray (30). When removable wear pad (32) becomes worn and must be replaced, holder plate (34) is removed, worn pad (32) is replaced with a new removable wear pad (32), and holder plate (34) is put back in place. Coupler (16) is not removed from coupler housing (14) during the replacement process. Removable wear pad (32) may be made of materials that increase lubrication and decrease friction between coupler (16) and removable wear pad (32).

13 Claims, 2 Drawing Sheets

COUPLER UNIT WEAR PAD ASSEMBLY FOR RAILROAD EQUIPMENT

CROSS REFERENCE TO RELATED APPLICATIONS

This application is a continuation of Ser. No. 07/368,202 filed Jun. 19, 1989.

BACKGROUND OF THE INVENTION

This invention relates generally to coupler carrier wear on locomotives and train cars, and more specifically to a coupler unit wear pad holder assembly for easy replacement of worn carrier wear pads.

Train cars (and locomotives) have coupler units at each end for linking the cars together. Coupler units commonly consist of a coupler, or arm-like beam, with one end inserted into a coupler housing. A coupler housing is commonly known as a pocket. The other end of the coupler has a latch, or knuckle, which interlocks with the latch of a coupler on another train car thereby linking the train cars together. Several types of couplers commonly exist. One type of coupler, an E-type coupler, is generally an arm-like beam with a knuckle on one end as previously described. Another type of coupler, an F-type coupler, is similar to an E-type coupler but is interlocking. A rotary coupler allows train cars, particularly cars carrying aggregate materials, to be rotated on their side for dumping while remaining coupled to another car.

The end of the coupler opposite the latch is inserted into a pocket, or sleeve, commonly called a coupler housing. The coupler does not fit snugly within the housing but is allowed some movement as the train follows the track's radius through curves. This housing is attached to the underframe of a train car or locomotive.

The coupler rests on a metal pad, or carrier assembly, located inside the coupler housing. This carrier assembly generally consists of a metal wear pad welded to a base, commonly called a carrier. The carrier is mechanically attached to the coupler housing, usually with bolts or pins, or by a weld. The wear pad eventually becomes worn from the coupler sliding on it during operation of the train, and must be replaced.

To replace the carrier wear pad has historically been a difficult, time consuming and costly process. In many cases, the coupler must be removed from the coupler housing on train cars so that the worn carrier pad is accessible. The coupler must be completely removed from the coupler housing because the coupler's overhead clearance within the coupler housing is limited. As a result, simply raising the coupler off the wear pad does not allow enough room to remove the wear pad. Furthermore, this requires a mechanical lift due to the extreme weight of the coupler. The worn pad is removed from the carrier and a new pad is installed in place. Finally, the coupler is replaced.

The foregoing process is time consuming, inefficient, and possibly dangerous. Workers must often be employed for several hours to complete the task. The train car is out of commission for an extended period of time while the carrier is being overhauled. Also, the use of flame cutting and welding devices can cause serious accidental injuries.

The present invention provides a novel wear pad assembly that allows for quick, safe and inexpensive replacement of a worn pad. This is accomplished through a holder-tray strategically located on the coupler carrier which accepts replaceable wear pads.

An important object of the present invention is to provide a wear pad assembly wherein it is unnecessary to remove the coupler to change a worn out pad.

Another object of this invention is to provide a wear pad assembly which does not require welding to change a worn out plate after the present invention is initially installed on a locomotive or train.

Another important object of this invention is to provide a wear pad assembly which requires no flame cutting to change a worn out carrier wear pad.

A further object of the present invention is to provide a wear pad assembly which yields a longer plate wear life through the use of materials that increase lubrication and decrease friction.

Another object of the present invention is to provide a wear pad assembly which results in less expense, faster, and safer replacement of worn wear pads.

A further important object of the present invention is to provide a novel method for replacing worn wear pads on coupling units of railroad equipment.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith, and in which like reference numerals are used to indicate like parts in the various views.

This invention specifically contemplates a wear pad assembly for coupler units of railroad equipment, such as locomotives or train cars. This description illustrates the wear pad assembly of the present invention on a train car. It should be understood that this is not a limitation and the device is intended for use with locomotives and other railroad equipment.

Figure 1:
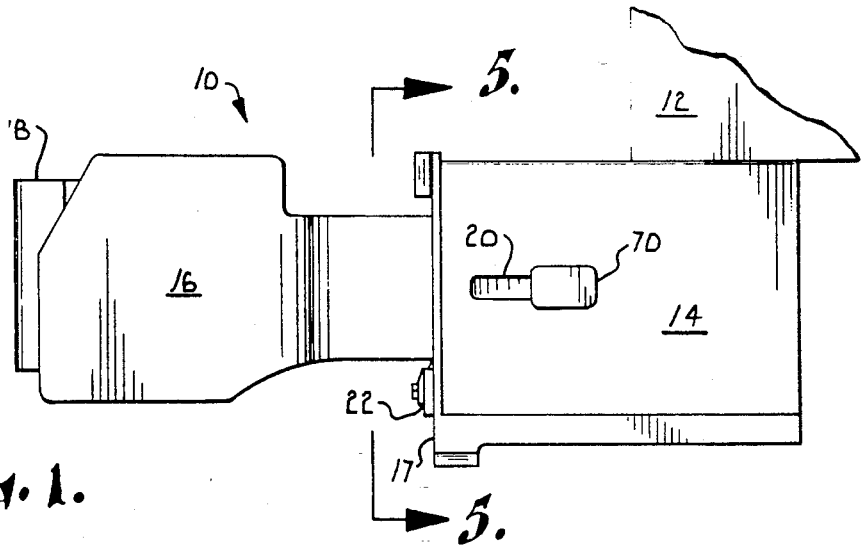
FIG. 1 is a side elevational view of a coupler-carrier unit on a train car.

Referring initially to FIG. 1, numeral 10 generally denotes a coupler unit of a train car 12. Coupler housing 14 (a pocket) receives coupler 16. Pin 70 is placed through a slot 20 on each side of coupler housing 14 and through coupler 16 thereby securing coupler 16 in coupler housing 14. Slot 20 allows generally horizontal movement of coupler 16 within housing 14. Coupler 16 has a knuckle 18 which interlocks with the knuckle (not shown) of a coupler on another train car thereby linking the two cars together. The wear pad assembly as described herein is denoted by numeral 22 and is located on coupler carrier 17 of coupler housing 14.

Figure 2:
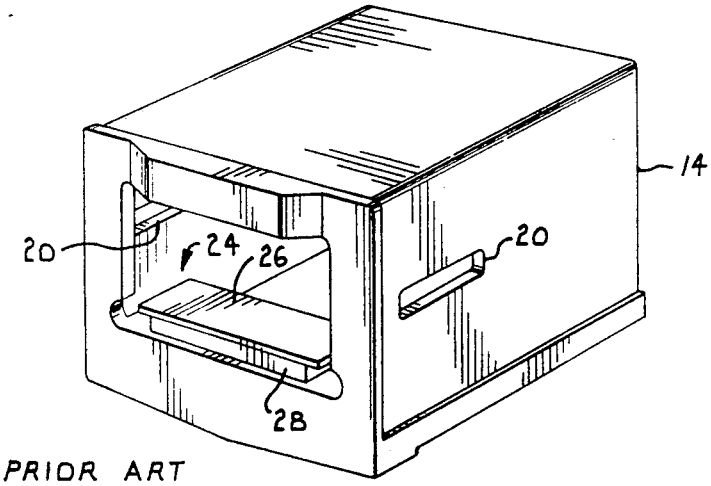
PRIOR ART Fig. 2.
FIG. 2 is a perspective view of the prior art carrier assembly.

Turning to FIG. 2, the prior art carrier configuration 24 is shown. Carrier configuration 24 is comprised of a carrier wear plate 26 which is pinned, bolted or welded to carrier base 28. Carrier base 28 is mechanically attached, usually with pins or bolts, to coupler housing 14. During operation of the train, coupler 16 slides on wear plate 26. Eventually, wear plate 26 becomes worn and must be replaced.

Replacing the prior art wear plate 26 is a time consuming process. First, due to the limited spacing within coupler housing 14, coupler 16 must be completely removed from coupler housing 14. As a result of its extreme weight, removal of coupler 16 requires the use of a mechanical lift. Next, prior art carrier configuration 24 must be removed from coupler housing 14. Once carrier configuration 24 is removed, the worn prior art wear plate 26 is flame cut from carrier base 28. A new wear plate is welded to the carrier base 28. Finally coupler 16 is replaced back within coupler housing 14.

Figure 4:
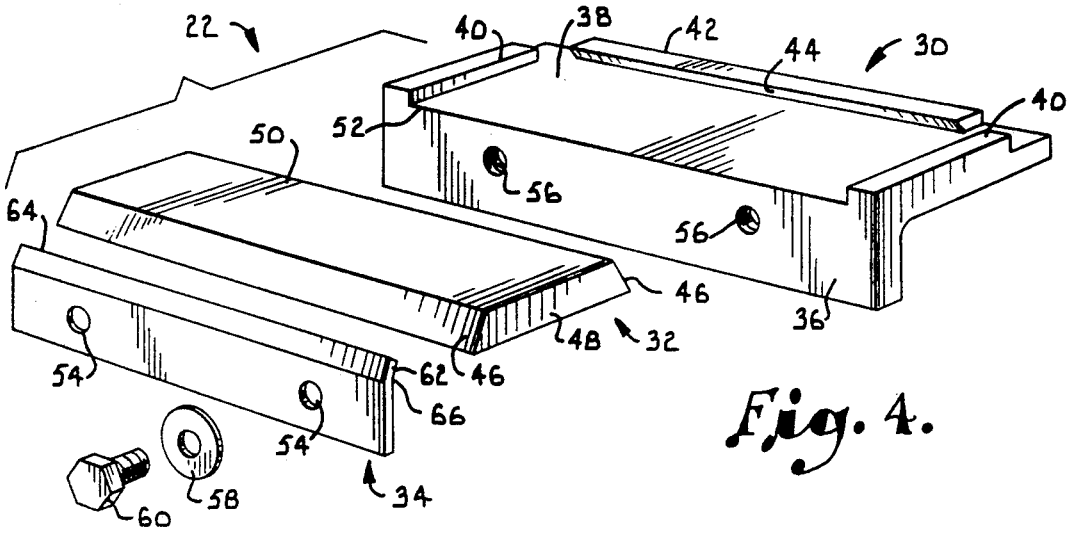
FIG. 4 is an exploded perspective view of the wear pad assembly of the present invention.

The principal components of this invention are best seen in FIG. 4. Wear pad assembly 22 consists generally of a holder-tray 30, a removable wear pad 32, and a holder plate 34. Holder-tray 30 serves as a base and has a downwardly extending facial portion 36, having threaded holes 56, and a platform 38. Lateral edges, or ribs, 40 extend upwardly from platform 38 at each end of platform 38. Rearward edge, or ribs, 42 extends upwardly from platform 38 and has a beveled portion 44.

Holder-tray 30 may be constructed from one integral piece of steel, whereby platform 38 is machined out leaving lateral edges 40 and rearward edge 42. Alternatively, lateral edges 40 and rearward edge 42 may be welded to platform 38. To lend stability to holder-tray 30, and to prevent lateral edges 40 from shearing off during operation of the train, lateral edges 40 are preferably machine formed, as opposed to welded onto platform 38, and do not have beveled portions. It should be understood lateral edges 40 may also have beveled portions facing platform 38 if desired. It should be understood that rearward edge 42 and lateral edges 40 may be constructed so as to intersect at the rear most corners of platform 38. The design as shown is merely a preferred embodiment and is not intended as a limitation.

Removable wear pad 32 preferably has front and back mitered edges 46 formed at substantially the same angle as beveled portion 44 of rearward edge 42 of holder-tray 30. Each end 48 of removable wear pad 32 is substantially perpendicular to the upper surface 50 of wear pad 32.

Wear pad 32 is preferably made of a durable light weight compound material composed of nylon and graphite. As coupler 16 slides on pad 32, graphite from pad 32 will fill the pores of coupler 16. This increases lubrication and decreases friction between coupler 16 and pad 32, resulting in an increased wear life of pad 32. Alternatively, pad 32 can be made from a composite material or hard alloy such as manganese. It should be understood that this invention is not limited to the use of the these wear pad materials since other materials may be substituted for those mentioned.

Removable wear pad 32 is dimensioned to fit snugly within holder-tray 30 on platform 38. When pad 32 is placed on platform 38, lateral edges 40 prevent pad 32 from sliding laterally. One mitered edge 46 meets beveled portion 44 of rearward edge 42. The remaining mitered edge extends to the forward most edge of platform 38 to meet the upper edge 52 of facial portion 36. The thickness of wear pad 32 allows it to extend upwardly beyond lateral edges 40 and rearward edge 42.

Once removable wear pad 32 is in place within holder-tray 30, holder plate 34 is positioned so that openings 54 align with threaded holes 56 of facial portion 36 of holder-tray 30. A washer 58 is placed over each opening 54 and a bolt 60 is placed through each opening 54 and screwed tightly into threaded opening 56 to keep holder plate 34 firmly in place. Holder plate 34 has an upper angled portion 62 which, in conjunction with beveled portion 44, forms a lip combination which overlaps mitered edges 46 of removable wear pad 32 thereby holding removable wear pad 32 in place. Upper angled portion 62 may be formed by bending holder plate 34 along bend-line 66 or by machine forming holder plate 34 in the desired shape. Preferably, the upper most edge 64 of holder plate 34 extends upwardly to substantially the same level as lateral edges 40 and rearward edge 42 of holder-tray 30. Also, the bend-line 66 of upper angled portion 62 preferably aligns with the upper edge 52 of facial portion 36.

Figure 3:
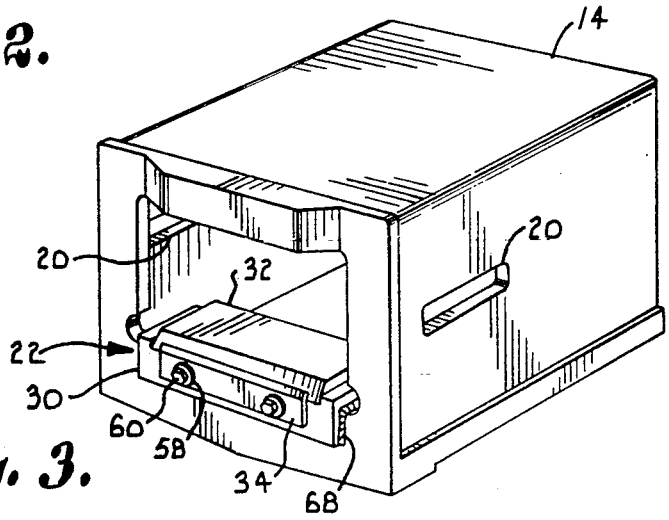
FIG. 3 is a perspective view of the wear pad assembly in accordance with the present invention.

Turning to FIG. 3, wear pad assembly 22 is shown in position on coupler carrier 17 of coupler housing 14. Assembly 22 is fastened to coupler carrier 17 by welds 68 along the periphery of holder-tray 30. Holder-tray 30 is welded to coupler carrier 17 of coupler housing 14. Unlike the prior art configuration, after holder-tray 30 is initially welded in place, subsequent welding and flame cutting are not required. It should be understood that holder-tray 30 may be fastened to coupler carrier 17 by bolts or pins or other alternative means.

Figure 5:
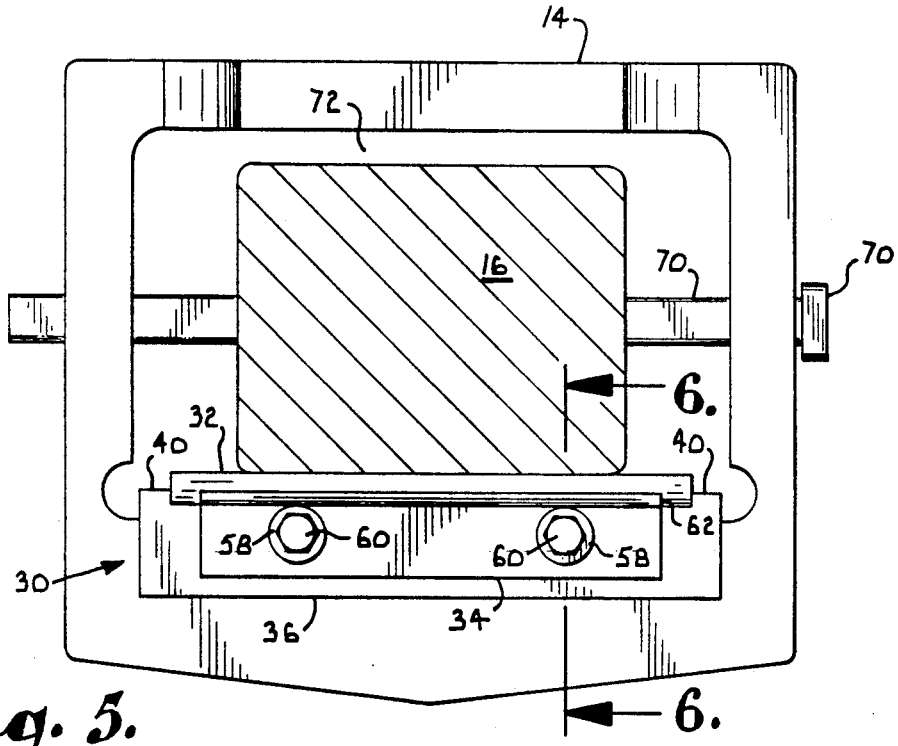
FIG. 5 is a transverse sectional view taken along line 5—5 of FIG. 1 showing the position of the coupler with respect to the wear pad assembly of the present invention.

FIG. 5 is a transverse sectional view taken along line 5—5 of FIG. 1 showing the position of coupler 16 within coupler housing 14. Coupler 16 rests on removable wear pad 32 of wear pad assembly 22. Pin 70 is placed through slots 20 (one slot on each side of coupler housing 14) and coupler 16 thereby holding coupler 16 within coupler housing 14. As the train climbs and descends grades or accelerates and slows down, coupler 16 moves in and out of coupler housing 14 on removable wear pad 32 to the extent pin 70 can travel in slots 20. Furthermore, coupler 16 may temporarily lift off of wear pad 32 and then drop back onto wear pad 32. Also, as the train rounds curves, coupler 16 follows the radius of the track and moves laterally on wear pad 32.

When removable wear pad 32 has become sufficiently worn due to extended train operation, it may be easily replaced. Coupler 16 is lifted off of wear pad 32. It is not necessary as in the prior art to remove coupler 16 from coupler housing 14 or to disassemble coupler unit 10 to replace the worn pad. Area 72 (FIG. 5) allows coupler 16 to be raised within coupler housing 14 so that wear pad 32 is accessible. Lifting coupler 16 in the manner described does not require the use of a large lifting device as the prior art required. Instead, workers may lift coupler 16 manually if permitted to do so, or a jack or similar device could be employed.

Holder plate 34 is removed by removing bolts 60 and washers 58. The worn removable wear pad 32 is taken out and replaced with a new removable wear pad. Holder plate 34 is bolted tightly back in place and the coupler is lowered back onto the new removable wear pad 32. Also, if a coupler is wearing the pad 32 only in a limited area due to a coupler defect or another reason, pad 32 may be quickly turned around thereby increasing its usefulness.

Figure 6:
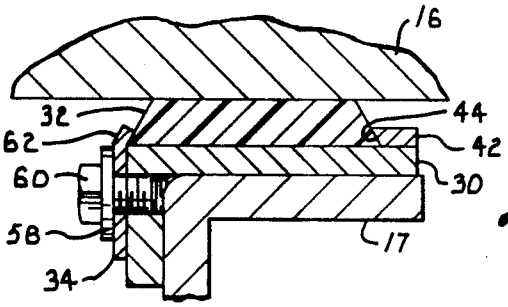
FIG. 6 is a sectional view taken along line 6—6 of FIG. 5 of the present invention.

As seen best in FIG. 6, which is a sectional view taken along line 6—6 of FIG. 5, removable wear pad 32 extends upwardly substantially further than the other components of wear pad assembly 32. This allows only pad 32 to come into contact with coupler 14, thereby preventing damage to holder-tray 30 and holder plate 34. As seen, it is important that bolts 60 do not extend entirely through holder-tray 30 so they will not interfere with the close fit of assembly 22 with coupler housing 14.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since it is possible embodiments may be made of the invention without departing from the spirit and scope thereof, it is to be understood that all matter herein set forth or shown in the accompanying drawings is to be interpreted a illustrative and not in a limiting sense.

Having described our invention, we claim:

1. A coupler unit for railroad equipment comprising:

a coupler;

a coupler housing, said coupler being engaged within said coupler housing during the normal operation of said coupler unit, said coupler housing comprising;

a wear pad, whereby said coupler contacts said wear pad during operation of said railroad equipment; and means for removably mounting said wear pad on said coupler housing without removing said coupler from said coupler housing, said mounting means including at least one upwardly extending beveled rib for holding said wear pad substantially along at least one outer peripheral edge thereof.

2. The coupler unit of claim 1 including a plate detachably connected to said mounting means for further holding said war pad on said mounting means.

3. The coupler unit of claim 2 wherein said plate includes an upper angled portion which extends above said mounting means and inwardly over an outer edge of said wear pad thereby holding said wear pad in place.

4. The coupler unit of claim 3 wherein said wear pad includes mitered edges whereby said mitered edges form a substantially contiguous relationship with said upper angled portion of said plate and said beveled portion of said upwardly extending rib of said mounting means.

5. The coupler unit of claim 4 wherein said mounting means is a holder tray.

6. The coupler unit of claim 1 wherein said mounting means including said upwardly extending beveled rib is comprised of one integral piece of material.

7. A wear pad assembly for coupler units of railroad equipment, said coupler units each including a coupler engaged within a coupler housing, comprising:

a wear pad, whereby said coupler contacts said wear pad during operation of said railroad equipment; and means for removably mounting said wear pad on said coupler housing without removing said coupler from said coupler housing, said mounting means including a plate extending upwardly from said base and at least one means for fastening said plate in a substantially contiguous relationship with a portion of said wear pad for holding said wear pad in place when said fastening means is properly adjusted.

8. The wear pad assembly of claim 7 wherein said base further includes at least one upwardly extending rib located substantially along at least one outer peripheral edge of said base for further holding said wear pad in place.

9. The wear pad assembly of claim 8 wherein said upwardly extending rib includes a beveled portion for overlapping at least one outer peripheral edge of said wear pad.

10. The wear pad assembly of claim 9 wherein said wear pad includes at least one mitered edge for forming a substantially contiguous relationship with said beveled portion of said rib to further hold said wear pad in place.

11. The wear pad assembly of claim 7 wherein said plate includes an upper angled portion which extends above said mounting means and inwardly over an outer edge of said wear pad thereby further holding said wear pad in place.

12. The wear pad assembly of claim 11 wherein said wear pad includes at least one mitered edge for forming a substantially contiguous relationship with said angled portion of said plate to further hold said wear pad in place.

13. A coupler unit for railroad equipment comprising:

a coupler;

a coupler housing, said coupler being engaged within said coupler housing during normal operation of said coupler unit, said coupler housing comprising;

a wear pad having mitered edges, whereby said coupler contacts said wear pad during operation of said railroad equipment;

a holder tray, whereby said wear pad is removably mounted on said holder tray and wherein said wear pad is removed for replacement while said coupler remains engaged within said coupler housing, said holder tray comprising;

at least one upwardly extending beveled rib located substantially along an outer peripheral edge of said holder tray;

a plate detachably connected to said holder tray and extending upwardly from said holder tray, said plate including an upper angled portion whereby said upper angled portion of said plate and said beveled rib of said holder tray from a substantially contiguous relationship with said mitered edges of said wear pad thereby holding said wear pad in place.

* * * * *